United States Patent [19]

Habich

[11] 4,061,331

[45] Dec. 6, 1977

[54] DOCUMENT RECEIVING APPARATUS

[75] Inventor: Adolph Broadus Habich, Austin, Tex.

[73] Assignee: International Business Machines Corporation, Armonk, N.Y.

[21] Appl. No.: 693,817

[22] Filed: June 7, 1976

[51] Int. Cl.[2] ..... B65H 31/00; B65H 31/20

[52] U.S. Cl. ..... 271/223; 214/6 S; 271/217

[58] Field of Search ..... 271/219, 217, 220, 223, 271/224, 207, 215, 218, 214, 213, 80, 177, 221, 222, 208, 209, 211; 214/6 D, 6 S

[56] References Cited

U.S. PATENT DOCUMENTS

| | | | |
|---|---|---|---|
| 1,887,023 | 11/1932 | Hunziker | 271/220 X |
| 2,771,293 | 11/1956 | Guttridge | 271/219 |
| 3,046,010 | 7/1962 | Schneider | 271/219 |
| 3,458,187 | 7/1969 | Draugelis et al. | 271/219 |

FOREIGN PATENT DOCUMENTS

| | | | |
|---|---|---|---|
| 709,218 | 5/1954 | United Kingdom | 271/220 |

*Primary Examiner*—Bruce H. Stoner, Jr.
*Attorney, Agent, or Firm*—James H. Barksdale, Jr.

[57] ABSTRACT

An apparatus for receiving documents which tend to kite and/or curl upon being fed thereinto. The apparatus is made up of an elevatable platform which reduces curling problems upon low velocity feeding, and document elevatable wings which trap the leading edge of each document and overcome any curling and kiting problems during high velocity feeding.

4 Claims, 1 Drawing Figure

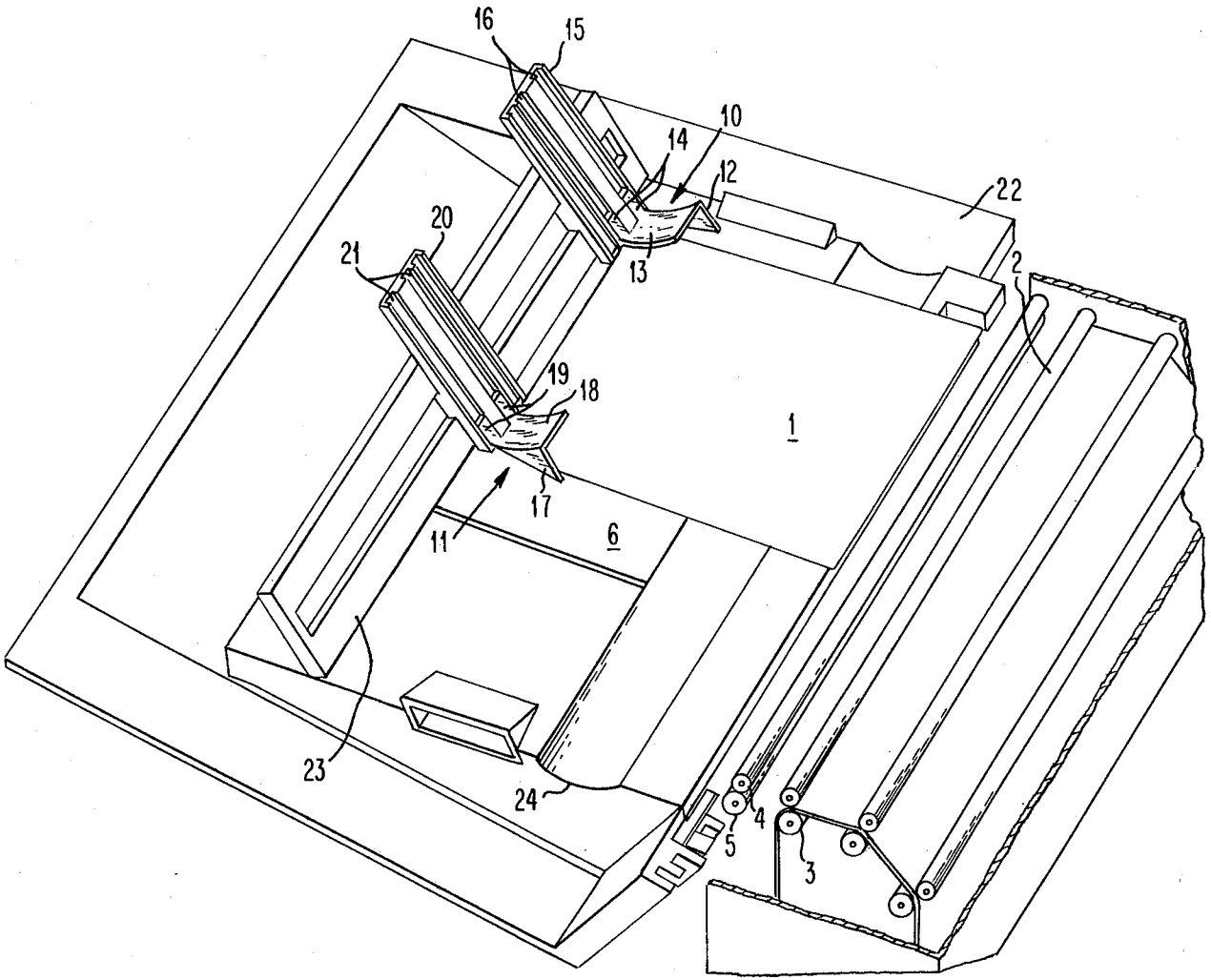
1
2
3
4
5
6
10
11
12
13
14
15
16
17
18
19
20
21
22
23
24

DOCUMENT RECEIVING APPARATUS

CROSS-REFERENCE TO RELATED APPLICATIONS

U.S. Pat. application Ser. No. 691,746, entitled "Document Feeding Apparatus", filed June 1, 1976, having William M. Jenkins as inventor.

BACKGROUND OF THE INVENTION

1. Field of the Invention

This invention generally relates to document handling after a document has been printed. More specifically, this invention relates to an apparatus for receiving printed documents fed thereinto, and reducing problems associated with document kiting and curling during said feeding.

2. Description of the Prior Art

The closest known prior art is U.S. Pat. No. 3,458,187. Disclosed in this patent are strips which extend from near the entrance of a tray to the far edge thereof. Functionally, the apparatus disclosed in this patent for catching the leading edge of each document fed into a hopper or tray is to some degree similar to that disclosed in this application. Structurally, it is much more complicated and presents operator problems in terms of ready removal of a stack of documents. With the apparatus of the instant application, multivelocity feeding is accommodated and once a number of documents have been received and stacked in an orderly manner, access for purposes of removal presents no problem. The documents may merely be grasped about a side edge and removed.

SUMMARY OF THE INVENTION

A document receiving apparatus is provided having a platform upon which documents are sequentially stacked. The apparatus also has document elevatable wings which form a throat for catching or trapping the leading edge of each document during feeding onto the platform. The platform is elevatable about its receiving end for providing a base for receiving the documents in essentially the same plane in which they are fed into the apparatus. The wings have side plates and upswept tops and are slideable upwardly in guides under the influence of incoming documents. During the initial stage of a feeding cycle, the documents are fed onto the platform at a low velocity. By controlling the elevation of the platform during this stage, curling problems are minimized. The wings extend toward the incoming documents only a sufficient extent to trap the leading edge of each document before the document is totally under the influence of printing station exit rollers. When the leading edge has been trapped, the final stage of the feeding cycle begins and the document is accelerated to a high velocity by the printing station exit rollers. This causes the document to be forced under the wings and the wings to be elevated. Since the leading edge has been trapped, kiting and/or curling during this final stage are overcome.

BRIEF DESCRIPTION OF THE DRAWING

In the drawing there are shown in perspective the document receiving apparatus of this invention along with printing station feeding apparatus for feeding documents into the receiving apparatus.

DESCRIPTION OF THE PREFERRED EMBODIMENT

For a more detailed understanding of the invention, reference is made to the attached drawing. For purposes herein, reference to documents is primarily intended to include individual sheets of paper. In the drawing there are shown rollers 2, 3, 4 and 5. For purposes herein, rollers 2 and 3 can be considered equivalent to ball 10, and pulley 6 and belt 9, repectively, in the above cross-referenced application. Rollers 4 and 5 can be considered equivalent to pinch roller 13 and exit roller 12, respectively, in the above cross-referenced application. As is pointed out in the above cross-referenced application, when a document being a sheet of paper such as that denoted by reference numeral 1 is fed from the right to the left toward rollers 2 and 3, it is eventually picked up thereby and further fed to the left between rollers 4 and 5. Roller 5 is slip clutch connected to its drive means and is normally rotating at a higher rotational velocity than roller 3. When sheet 1 is being fed by roller 5, and is still between rollers 2 and 3, it will tend to be restrained by rollers 2 and 3. At this time, roller 5 will be slipping against its clutch, and rotating at the same rotational velocity as roller 3. As sheet 1 continues to be fed to the left, it will be fed onto the right end or receiving end of platform 6. The above constitutes the initial stage of a feeding cycle where sheet 1 is fed at a low velocity. When the trailing edge of sheet 1 eventually clears rollers 2 and 3, sheet 1 will be accelerated and fed to the left at a high velocity by exit roller 5. This is the beginning of the final stage of the feeding cycle. During this final stage, sheet 1 will be forced under wings generally denoted by reference numerals 10 and 11.

Wings 10 and 11 form a throat for trapping the leading edges of documents fed onto platform 6. As is pointed out in the above cross-referenced application, the spacing between rollers 2 and 3 and rollers 4 and 5 is such that the leading edge of sheet 1 is under wings 10 and 11 before the trailing edge of sheet 1 clears rollers 2 and 3. Wing 10 is made up of side plate 12 and upswept top 13. Wing 10 has integral guide tangs 14 which communicate with guide slots 16 in guide 15. In like manner, wing 11 has side plate 17 and upswept top 18. Wing 11 also has guide tangs 19 which communicate with guide slots 21 in guide 20. Guides 15 and 20 are carried by carrier 23. Guide 20 is slideable therealong for adjustment to the width of sheet 1. Carrier 23 is adjustable back and forth (left and right) to accomodate the length of sheet 1.

Platform 6 is carried by table 22 and is pivotable about its left end. This end of platform 6 is opposite its receiving end which is adjacent rollers 4 and 5. This pivoting permits the receiving end of platform 6 to be elevated and lowered. By controlling the elevation of platform 6, a base can be provided for accepting an incoming sheet in essentially the same plane as its leading edge when exited from rollers 4 and 5. The exit plane of the leading edge is to be slightly above the plane of the base. The base will be the platform if empty, or otherwise the topmost sheet of a stack on platform 6. With the elevation of the receiving end of platform 6 properly positioned, any tendency toward downward temperature or humidity curling when sheets are fed onto platform 6 will present few problems. If the elevation of the base is too low, there will be a tendency for sheets to roll. As the stack of sheets increases in height on platform 6, the receiving end of platform 6 will eventually be lowered to its lowermost extent. When this position is attained and the platform has been filled, the stack of sheets may be removed by grasping the side edges thereof. Recess 24 is for facilitating this removal.

With the above in mind, any downward curl in a sheet during low velocity feeding will result in its leading edge skidding along the base. If all incoming sheets were flat or had a downward curl, then low velocity feeding alone could be utilized. Also, the necessity for the wings would be alleviated. The fact of the matter is that the direction of curl caused by temperature and/or humidity is not predictable. Upward curl can result in shingling and an unorderly stack even when only low velocity feeding is considered. If, on the other hand, sheets are accelerated and/or fed at high velocity, there will be a tendency for the sheets to kite. Curling accentuates this problem. In order to control the sheets during feeding and stacking, and at the same time keep required structure to a minimum, multivelocity feeding is utilized in this invention.

With the apparatus shown, a sheet is substantially controlled when under the influence of rollers 2, 3, 4 and 5, and fed at a low velocity. As pointed out above, downward curling during this stage of the feeding cycle presents few problems if the elevation of the receiving end of platform 6 is properly maintained. Any upward curl will eventually be overcome by upswept tops 13 and 18 of wings 10 and 11 when the leading edge is fed thereunder. When the sheet is only under the driving influence of rollers 4 and 5 later during the feeding cycle, the degree of control is reduced. This is when the sheet is accelerated to a high velocity. At this time, the leading edge is already under, or trapped by, wings 10 and 11 which will prevent kiting. The sheet is accelerated to a high velocity during this stage of the feeding cycle to drive the sheet under wings 10 and 11, cause elevation of wings 10 and 11, and align the sheet.

From the above, the most important point to note is that curling is the most significant problem at low velocity. The wings and elevatable platform disclosed herein are utilized to overcome this problem in order that sheets may be stacked in an orderly manner. In order to take full advantage of the wings as structured, the incoming sheets must be accelerated. This is to insure that the sheets are positioned under the wings and that the wings are elevated. In a normal situation, acceleration can cause kiting and prevent sheets from being stacked in an orderly manner. Since the leading edges of the sheets are trapped by the wings in this application prior to acceleration, any kiting of the sheets presents no problem. Wings 10 and 11 extend sufficiently toward the receiving end of platform 6 in order that the leading edge of the sheet is trapped prior to being accelerated. That is, with a given spacing between rollers 2 and 3, and 4 and 5, wings 10 and 11 extend a sufficient distance toward rollers 4 and 5 such that the leading edge of the sheet is trapped by wings 10 and 11 before the sheet is totally under the influence of roller 4 and 5 and accelerated.

With the above described apparatus, operation begins with the right edge of platform 6 being in its uppermost position. Sheets are sequentially fed from between rollers 2 and 3 and rollers 4 and 5 onto platform 6. When the trailing edge of a sheet being fed onto platform 6 clears rollers 2 and 3, it is accelerated by roller 5 onto platform 6 and forced under wings 10 and 11. This causes the raising or elevation of wings 10 and 11. During the subsequent feeding of additional sheets onto platform 6, the receiving end thereof will be lowered. When platform 6 has been filled, the operator procedure is to grasp the stack of sheets about their side edges and readily remove them.

In summary, a document receiving apparatus is provided having a platform upon which documents are sequentially stacked. The apparatus also has document elevatable wings which form a throat for catching or trapping the leading edge of documents during feeding onto the platform. The platform is elevatable about its receiving end for providing a base for receiving the documents in essentially the same plane in which they are fed into the apparatus. The wings have side plates and upswept tops and are slideable upwardly in guides under the influence of incoming documents. During the initial stage of a feeding cycle, the documents are fed onto the platform at a low velocity. By controlling the elevation of the platform during this stage, curling problems are minimized. The wings extend toward the incoming documents only a sufficient extent to trap the leading edge of each document before the document is totally under the influence of printing station exit rollers. When the leading edge has been trapped, the final stage of the feeding cycle begins and the document is accelerated to a high velocity by the printing station exit rollers. This causes the document to be forced under the wings and the wings to be elevated. Since the leading edge has been trapped, kiting or curling during this final stage are overcome.

While the invention has been particularly shown and described with reference to a preferred embodiment, it will be understood by those skilled in the art that various changes may be made without departing from the spirit and scope of the invention.

What is claimed is:

1. An apparatus for receiving documents fed thereinto at a low velocity during an initial stage of a feeding cycle and at a high velocity during a final stage of said feeding cycle by spaced low and high velocity feeding means located adjacent said apparatus, said apparatus comprising:

a. platform means having a positionable receiving end for providing a base for receiving the leading edge of a document when fed thereonto at a low velocity during said initial stage; and b. throat means for trapping said leading edge, and being located adjacent an end opposite said receiving end, and extending toward said receiving end a sufficient extent to 1. trap said leading edge prior to said document being fed at said high velocity, and
2. not restrict access for removal of documents from said apparatus, said throat means including a number of wings, each comprising a side plate and an upswept top, and means supporting said wings for movement toward and away from said platform such that said wings are elevatable under the influence of said document when fed under said upswept top of said wings at said high velocity.

2. An apparatus according to claim 1 wherein said supporting means includes carrying means connected to said platform means for carrying said wings and being adjustable for accommodating different length documents.

3. An apparatus according to claim 2 including guide means for each of said wings connected to said carrying means and through which said wings are carried by said carrying means, one of said guide means being slideable along said carrying means for accommodating different width documents.

4. An apparatus according to claim 3 including guide tangs connected to said wings and guide slots in said guide means for cooperating with said guide tangs such that said wings can be elevated under the influence of said document when fed at said high velocity.

* * * * *